US010421650B2

(12) United States Patent
Schmidt

(10) Patent No.: US 10,421,650 B2
(45) Date of Patent: Sep. 24, 2019

(54) WINCH, METHOD FOR CONTROLLING OPERATION OF A WINCH AND METHOD FOR OPERATING A WINCH

(71) Applicant: JENOPTIK Advanced Systems GmbH, Wedel (DE)

(72) Inventor: Joachim Schmidt, Tornesch (DE)

(73) Assignee: JENOPTIK Advanced System GmbH, Wedel (DE)

( * ) Notice: Subject to any disclaimer, the term of this patent is extended or adjusted under 35 U.S.C. 154(b) by 129 days.

(21) Appl. No.: 15/742,696

(22) PCT Filed: Jul. 7, 2016

(86) PCT No.: PCT/EP2016/066106

§ 371 (c)(1),
(2) Date: Jan. 8, 2018

(87) PCT Pub. No.: WO2017/005850

PCT Pub. Date: Jan. 12, 2017

(65) Prior Publication Data

US 2018/0201489 A1 Jul. 19, 2018

(30) Foreign Application Priority Data

Jul. 7, 2015 (DE) ..... 10 2015 009 057

(51) Int. Cl.
*B66D 1/74* (2006.01)
*B66D 1/46* (2006.01)
(Continued)

(52) U.S. Cl.
CPC ..... *B66D 1/741* (2013.01); *B66D 1/46* (2013.01); *B66D 1/7415* (2013.01); *B66D 1/76* (2013.01);
(Continued)

(58) Field of Classification Search
CPC ..... B66C 13/23; B66D 1/46; B66D 1/7415; B66D 1/12; B66D 1/38; B66D 1/7436; B66D 1/7457
See application file for complete search history.

(56) References Cited

U.S. PATENT DOCUMENTS 2,380,626 A * 7/1945 Zeilman ..... B66C 23/36 212/172
2,991,024 A 7/1961 Goode
(Continued)

FOREIGN PATENT DOCUMENTS

DE 102012013527 A1 1/2014
FR 2843954 A1 3/2004
(Continued)

OTHER PUBLICATIONS

International Search Report dated Oct. 17, 2016 in corresponding application PCT/EP2016/066106.
(Continued)

*Primary Examiner* — Emmanuel M Marcelo
(74) *Attorney, Agent, or Firm* — Muncy, Geissler, Olds & Lowe, P.C.

(57) ABSTRACT

A method for controlling operation of a winch, which has a capstan drive unit for hauling a cable into the winch and for paying the cable out of the winch, a main drive for driving the capstan drive unit, a cable drum for receiving the cable by winding up and unwinding the cable, a drum drive for driving the cable drum, wherein the drum drive and the main drive are operable independently of one another, and a rotational speed measuring device which is arranged in a cable inlet portion of the winch. The method has a step of reading a first rotational speed from the main drive and a second rotational speed from the rotational speed measuring device. In addition, the method has a step of determining a
(Continued)

torque value for setting a torque of the drum drive depending on the first rotational speed and the second rotational speed.

15 Claims, 3 Drawing Sheets

(51) Int. Cl.

| | |
|---|---|
| ***B66D 1/76*** | (2006.01) |
| *B66C 13/23* | (2006.01) |
| *B66D 1/12* | (2006.01) |
| *B66D 1/38* | (2006.01) |

(52) U.S. Cl.
CPC ..... *B66C 13/23* (2013.01); *B66D 1/12* (2013.01); *B66D 1/38* (2013.01)

(56) References Cited

U.S. PATENT DOCUMENTS

| | | | | |
|---|---|---|---|---|
| 3,395,893 | A * | 8/1968 | Kumpf | B66D 1/08 242/397.3 |
| 3,448,962 | A | 6/1969 | Miller | |
| 3,507,478 | A | 4/1970 | Lewis | |
| 3,608,750 | A * | 9/1971 | Young | B65G 1/0414 414/277 |
| 3,843,096 | A | 10/1974 | Wilson et al. | |
| 4,625,946 | A * | 12/1986 | Clark, Jr. | B66D 5/24 254/274 |
| 4,750,659 | A * | 6/1988 | Maier | B41F 13/03 101/228 |
| 7,134,645 | B1 | 11/2006 | Johnson et al. | |
| 7,546,813 | B2 * | 6/2009 | Wrage | B63H 9/0685 114/102.1 |
| 2011/0130863 | A1 | 6/2011 | Porma et al. | |
| 2012/0023723 | A1 * | 2/2012 | Barker | G02B 6/4464 29/407.05 |
| 2016/0263983 | A1 * | 9/2016 | Christ | B60W 20/00 |

FOREIGN PATENT DOCUMENTS

| | | | |
|---|---|---|---|
| GB | 891145 | A | 3/1962 |
| WO | WO2009027580 | A1 | 3/2009 |

OTHER PUBLICATIONS

Translation of IPRP dated Jan. 18, 2018 in corresponding application PCT/EP2016/066106.

* cited by examiner

WINCH, METHOD FOR CONTROLLING OPERATION OF A WINCH AND METHOD FOR OPERATING A WINCH

This application is a National Stage of International Application No. PCT/EP2016/066106, filed on Jul. 7, 2016; and which claims priority of Application No. 10 2015 009 057.7 filed in Germany on Jul. 7, 2015, the entire contents of all of which are hereby incorporated by reference.

BACKGROUND OF THE INVENTION

Field of the Invention

The present invention relates to a method for controlling operation of a winch, to a method for operating a winch, to a corresponding apparatus, to a winch and to a corresponding computer program product.

Description of the Background Art

Winches, for example electric rescue winches, can have a capstan drive and a winch drum for winding and unwinding a winch cable. The drum can be co-driven directly by a main drive, wherein a speed difference arising as a result of winding layers can be compensated for by means of a slipping clutch.

DE 10 2012 013 527 A1 relates to an electrically operated cable drum as main component of an electric capstan winch which can be used as a recovery winch in helicopters.

SUMMARY OF THE INVENTION

Against this background, the present invention presents a method for controlling operation of a winch, a method for operating a winch, a corresponding apparatus, a winch and a corresponding computer program product according to the main claims. Advantageous refinements emerge from the respective sub claims and the following description.

According to embodiments of the present invention, in particular an open-loop control strategy or closed-loop control strategy or a control concept for winches, for example for electric winches such as electric rescue winches, for example, can be provided. Instead of coupling main drive and cable drum, two separate drives, for example electric drives, in each case motor with gearbox, can be provided in order to drive a capstan drive and a cable drum independently of each other. In particular, here a torque on the cable drum can be increased if cable slip on the capstan drive is determined. Put more precisely, for example a cable section between the capstan drive and the cable drum can be kept in tension by means of torque adjustment on the cable drum.

Advantageously, according to embodiments of the present invention, in particular on account of the open loop control strategy or the control concept of a winch having a winch cable, it is possible to operate at the optimum working point, which can both reduce wear of the cable and also wear in mechanical components of the winch. In addition, parts can be saved, such as, for example, a slipping clutch, wherein the wear of such a part can be prevented, for example in comparison with a rigid coupling between drum and capstan drive, a variable torque matching the respective operating situation and thus simple adaptation to changing boundary conditions can be implemented. In particular, it is possible to dispense with a slipping clutch, wherein both wear of a slipping clutch can be avoided and wear on the winch cable can be reduced.

A method for controlling operation of a winch is presented, wherein the method can be carried out in conjunction with a winch which has a capstan drive unit for hauling a cable into the winch and bringing out the cable from the winch, a main drive for driving the capstan drive unit, a cable drum for receiving the cable by winding up and unwinding the cable, a drum drive for driving the cable drum, wherein the drum drive and the main drive can be operated independently of each other, and has a speed measuring device which is arranged in a cable entry section of the winch, wherein the method has the following steps:

reading a first speed, which represents a speed of the main drive, and a second speed, which represents a speed measured by the speed measuring device; and determining a torque value for adjusting a torque of the drum drive as a function of the first speed and the second speed.

The winch can be embodied as an electric winch. Here, the winch can be used as a rescue winch or the like. The winch can also be capable of being installed in a vehicle, for example in an aircraft. The main drive can have an electric motor. Additionally or alternatively, the drum drive can have an electric motor. The drum drive and, additionally or alternatively, the main drive can also each have a gearbox. The cable entry section can represent a section of the winch in which the cable or winch cable enters the winch and, additionally or alternatively, leaves the winch. With respect to a cable running direction within the winch, the capstan drive unit with the main drive can be arranged between the cable drum having the drum drive and the cable entry section having the speed measuring device. The first speed can be understood to be a first speed value, and the second speed can be understood to be a second speed value. The first speed can be read via an interface to the main drive or a detection device assigned to the main drive. The second speed can be read via an interface to the speed measuring device.

According to one embodiment, the method can have a step of measuring the first speed and the second speed. Here, the first speed can be measured by using the main drive. The second speed can be measured by using the speed measuring device. The first speed and the second speed can be referred to a reference diameter or normalized here. Such an embodiment offers the advantage that reliable adjustment of the torque on the basis of a simply available data basis can be achieved.

In addition, the method can have a step of determining a speed difference and, additionally or alternatively, a speed ratio between the first speed and the second speed. Here, in the determination step, the torque value can be determined as a function of the speed difference and, additionally or alternatively, the speed ratio. Such an embodiment offers the advantage that slip of the cable on the capstan drive unit can be detected in a simple way and can be eliminated reliably by adapting the torque on the drum.

Furthermore, the method can have a step of performing a comparison of a mathematical relationship or link between the first speed and the second speed with a threshold value for the mathematical relationship or the link. Here, in the determination step, the torque value can be determined on the basis of a result of the comparison. The mathematical relationship can be a speed difference and, additionally or alternatively, a speed ratio between the first speed and the second speed. Here, in the performance step, a magnitude of the speed difference can be compared with the threshold value. The threshold value can, for example, represent a slip limit. Such an embodiment offers the advantage that, in the event that the threshold value is exceeded, counter-control can be carried out quickly and reliably by adjusting the torque, so that the mathematical relationship maintains the threshold value again.

In particular in the determination step, the torque value in a starting state of the winch can be determined as an initial value by using at least one cable load-dependent default value. Here, in the determination step, a reference table with cable load-dependent default values can be used. Such an embodiment offers the advantage that, even from a standstill of the drives of the winch, cable slip can be prevented reliably during a starting operation.

In addition, the method can have a step of providing a control signal for activating the drum drive. The control signal can represent the torque value here. By using the control signal, the drum drive can be operated. The control signal can in particular have a set point for the torque of the drum drive or a control variable or controlled variable for the torque. Such an embodiment offers the advantage that operational reliability of the winch can be increased in a simple and reliable way, and also wear of parts and of the cable can be prevented or reduced.

Also presented is a method for operating a winch, wherein the winch has a capstan drive unit for hauling in a cable into the winch and bringing out the cable from the winch, a main drive for driving the capstan drive unit, a cable drum for receiving the cable by winding up and unwinding the cable, a drum drive for driving the cable drum, wherein the drum drive and the main drive can be operated independently of each other, and a speed measuring device, which is arranged in a cable entry section of the winch, wherein the method has the following step:

controlling operation of the winch by carrying out the steps of an embodiment of the aforementioned method in order to haul a cable into the winch or to bring out the cable from the winch.

The operating method can advantageously be performed in conjunction with an embodiment of the aforementioned control method. In the control step, a control signal for activating the drum drive, which corresponds to the torque value determined according to one embodiment of the aforementioned method, can also be used.

According to one embodiment, in the control step, the torque of the drum drive can be adjusted until a mathematical relationship or a link between the first speed and the second speed complies with a threshold value. Such an embodiment offers the advantage that slip of the cable on the capstan drive unit can be reliably prevented or detected and eliminated.

Also presented is an apparatus which is designed to carry out, to activate or to implement the steps of a variant of a method presented here in corresponding equipment. In addition, by means of this design variant of the invention in the form of an apparatus, the object on which the invention is based can be achieved quickly and efficiently.

The apparatus can be designed to read input signals and, by using the input signals, to determine and provide output signals. An input signal can, for example, represent a sensor signal that can be read via an input interface of the apparatus. An output signal can represent a control signal or a data signal which can be provided on an output interface of the apparatus. The apparatus can be designed to determine the output signals by using a processing rule implemented in hardware or software. For example, for this purpose the apparatus can comprise a logic circuit, an integrated circuit or a software module and, for example, be implemented as a discrete component or comprised by a discrete component.

Also presented is a winch which has the following features: a capstan drive unit for hauling a cable into the winch and bringing out the cable from the winch, a main drive for driving the capstan drive unit, a cable drum for receiving the cable by winding up and unwinding the cable, a drum drive for driving the cable drum, wherein the drum drive and the main drive can be operated independently of each other, a speed measuring device, which is arranged in a cable entry section of the winch, and an embodiment of the aforementioned apparatus, wherein the apparatus is or can be connected to the main drive, the drum drive and the speed measuring device so as to be able to transmit signals.

An embodiment of the aforementioned apparatus can thus advantageously be used in conjunction with the winch, in particular to control operation of the winch and, additionally or alternatively, to operate the winch. In addition, an embodiment of one of the aforementioned methods can advantageously be carried out in conjunction with or by using the winch.

According to one embodiment, the speed measuring device can have a cable entry roller and a speed sensor. Here, the speed sensor can be designed to measure a speed of the cable entry roller. Such an embodiment offers the advantage that the second speed can be measured at the cable entry in a simple and reliable way.

In particular, the speed sensor can be designed to measure the speed of the cable entry roller in a non-contacting manner. Such an embodiment offers the advantage that the speed measurement can be carried out in a low-wear and accurate way.

In addition, the capstan drive unit can have a plurality of cable rollers for receiving a plurality of windings of the cable. Here, the plurality of cable rollers can be arranged in two packs radially spaced apart from each other with the same number of rigidly connected cable rollers lined up coaxially in a row. A first pack can be driven by the main drive. A second pack can be coupled mechanically to the first pack by means of a force transmission device. Such an embodiment offers the advantage that high loads on the cable can be absorbed, wherein slip of the cable on the drive unit can be minimized by its design characteristics.

Furthermore, axes of rotation of the capstan drive unit, the cable drum and speed measuring device can be parallel to one another within production tolerances. Such an embodiment offers the advantage that a form factor of the winch can be reduced, wherein the cable is or can be guided in the winch with little wear.

Also advantageous is a computer program product or computer program with program code, which can be stored on a machine-readable carrier or storage medium such as a semiconductor memory, a hard drive memory or an optical memory. If the program product or program is executed on a computer or an apparatus, then the program product or program can be used to carry out, implement and/or activate the steps of the method as claimed in one of the above-described embodiments.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Before exemplary embodiments are discussed, first of all principles and backgrounds of the present invention will be illustrated. In electric winches, in particular rescue winches, for example a capstan drive and a cable drum for winding up and unwinding the winch cable are provided. For example, the capstan drive performs transmission of the forces which arise from a load on the hook, wherein the cable drum winds up or unwinds the cable with a comparatively low tensile force. In a conventional, hydraulically operated rescue winch, for example, a drum is co-driven directly by a main drive, wherein a speed difference arising from winding layers of the cable is compensated for by means of a slipping clutch. As the cable is unwound from the cable drum, the latter must be unwound counter to the torque of the slipping clutch, as a result of which in particular necessary preloading of the cable arises. During winding up, a necessary tensile force is established automatically, for example, this depending on an overall situation, for example a weight on the hook, on environmental conditions, for example wet, or the like. Alternatively, a rigid coupling of the main drive to the cable drum can be provided, wherein a magnetic slipping clutch could be used. In this case, however, a fixed torque, which is intended to take many operating conditions into account, such as wet, must be provided for the torque of the cable drum.

In the following description of beneficial exemplary embodiments, the same or similar designations are used for the elements illustrated in the various figures and acting similarly, a repeated description of these elements being omitted.

Figure 1:
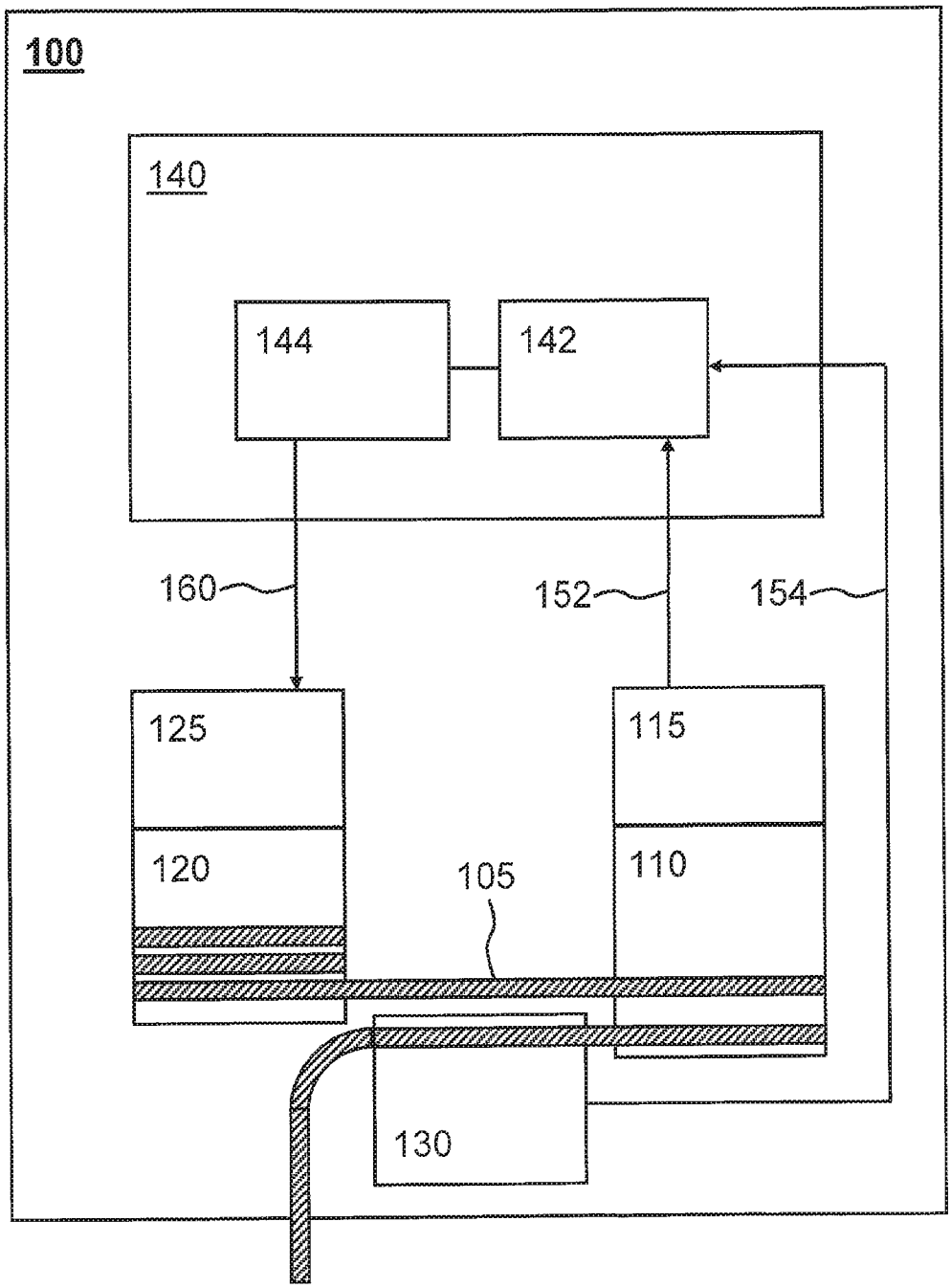
FIG. 1 shows a schematic illustration of a winch according to an exemplary embodiment.

FIG. 1 shows a schematic illustration of a winch 100 according to an exemplary embodiment. The winch 100 is, merely by way of example, an electric rescue winch. By using the winch 100, a cable 105 or winch cable 105 can be hauled into the winch 100 and brought out from the winch 100. The cable 105 is guided in the winch 100.

The winch 100 has a capstan drive unit 110 and a main drive 115. The capstan drive unit 110 is designed to haul the cable 105 into the winch 110 and to bring the cable 105 out of the winch 110. The main drive 115 is designed to drive the capstan drive unit 110. The main drive 115 is coupled to the capstan drive unit 110.

In addition, the winch 100 has a cable drum 120 and a drum drive 125. The cable drum 120 here is formed to receive and pay out the cable 105 by winding up and unwinding the cable 105. The drum drive 105 is designed to drive the cable drum 120. The cable drum 120 and the drum drive 125 are coupled to each other.

In the winch 100, the main drive 115 and the drum drive 125 can be operated independently or separately from each other. Expressed in another way, the main drive 115 and the drum drive 125 of the winch 100 can be activated individually.

The winch 100 also has a speed measuring device 130. The speed measuring device 130 is arranged in a cable entry section of the winch 100. The speed measuring device 130 is designed to measure a speed of a deflection roller over which the cable 105 is guided in the cable entry section.

In addition, the winch 100 has an apparatus 140 or control and/or operating apparatus 140. The apparatus 140 is connected to the main drive 115, the drum drive 125 and the speed measuring apparatus 130 so as to be able to transmit signals.

The apparatus 140 is designed to read a first speed signal 152 from the main drive 115 and a second speed signal 154 from the speed measuring device 130. Here, the first speed signal 152 represents a speed or first speed of the main drive 115. The second speed signal 154 represents a speed measured by means of the speed measuring device 130 or second speed. Thus, the apparatus 140 is designed to read the first speed or the first speed signal 152 and the second speed or the second speed signal 154.

The apparatus 140 is also designed to determine a torque value for adjusting a torque of the drum drive 125 as a function of the first speed and the second speed. Here, the apparatus 140 according to the exemplary embodiment shown in FIG. 1 is also designed to control operation of the winch 100 in order to haul the cable 105 into the winch 100 or to bring the cable 105 out of the winch 100.

Furthermore, the apparatus 140 is designed to output a control signal 160 to the drum drive 125. The control signal 160 is suitable to be used to activate the drum drive 125. Here, the control signal 160 represents the torque value determined in the apparatus 140. Thus, a torque of the drum drive 125 can be adjusted via the control signal 160.

The apparatus 140 is designed to read the first speed or the first speed signal 152 and the second speed or the second speed signal 154 and, by using the same, to generate and output the control signal 160.

According to the exemplary embodiment illustrated in FIG. 1, the apparatus 140 has a reading device 142 and a determination device 144. The reading device 142 is designed to read the first speed or the first speed signal 152 and the second speed or the second speed signal 154. The determination device 144 is designed to determine the torque value as a function of the first speed or the first speed signal 152 and the second speed or the second speed signal 154.

According to an exemplary embodiment, the determination device 144 is designed to determine the torque value in a starting state of the winch 100 as an initial value, by using at least one cable load-dependent default value.

According to an exemplary embodiment, the apparatus 140 is additionally designed to measure the first speed by using the main drive 115 and the second speed by using the speed measuring device 130. In particular, the apparatus 140 is also designed to determine a speed difference and/or a speed ratio between the first speed and the second speed. The apparatus 140 is designed to determine the torque value as a function of the speed difference and/or as a function of the speed ratio. Furthermore, according to an exemplary embodiment, the apparatus 140 is designed to carry out a comparison of a mathematical relationship between the first speed and the second speed with a threshold value for the mathematical relationship. Here, the apparatus 140 is designed to determine the torque value on the basis of a result of the comparison carried out. According to an exemplary embodiment, the apparatus 140 is also designed to provide the control signal 160. In particular, here the apparatus 140 is designed to provide the control signal 160 for output to the drum drive 125.

Thus, according to an exemplary embodiment, the apparatus 140 can also have a measuring device, a determination device, an implementation device and/or a providing device.

Figure 2:
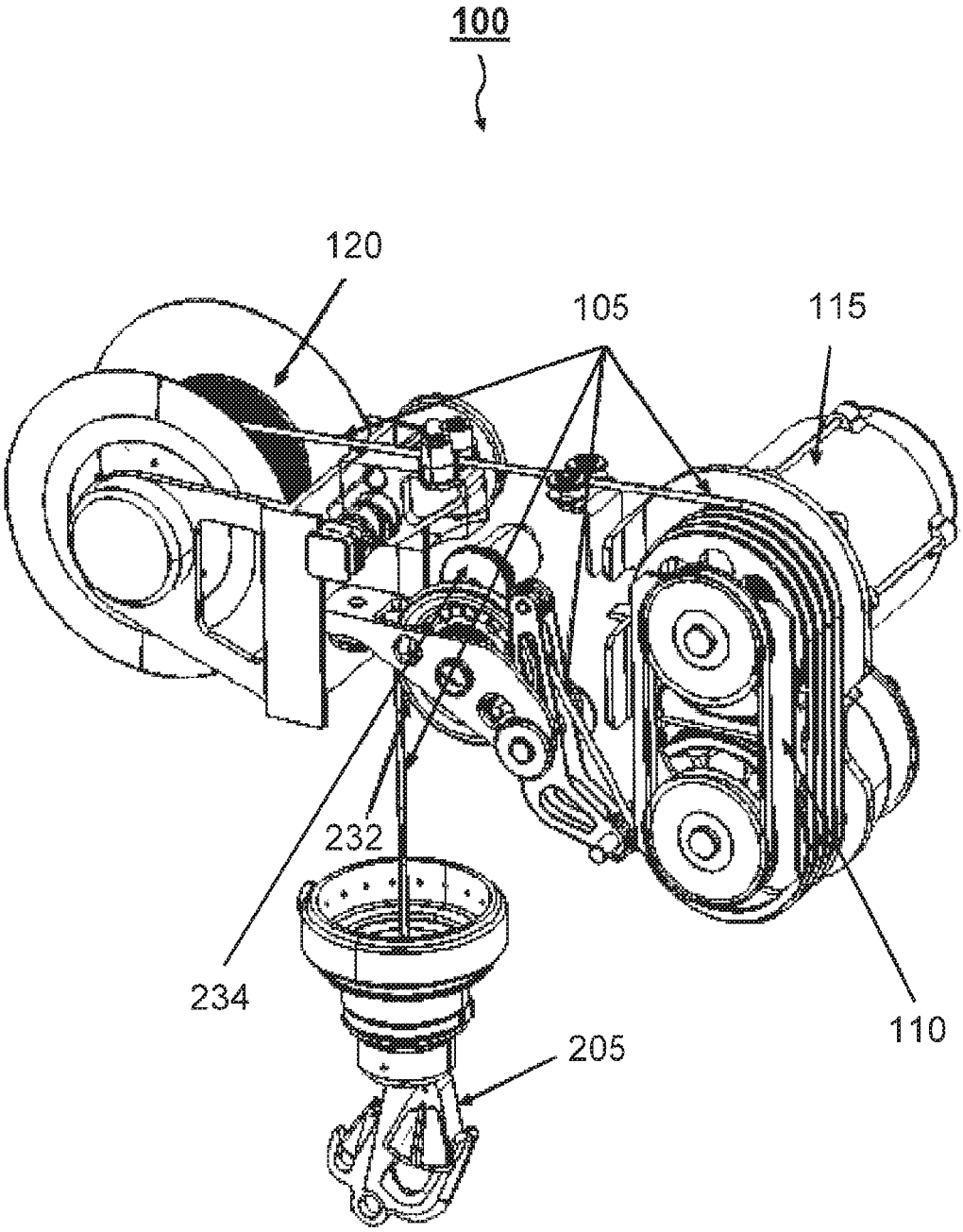
FIG. 2 shows a perspective illustration of a winch according to an exemplary embodiment.

FIG. 2 shows a perspective illustration of a winch 100 according to an exemplary embodiment. Here, the winch 100 is a winch from FIG. 1 or a similar winch. As distinct from the illustration in FIG. 1, of the winch 100 in FIG. 2 the cable 105 or winch cable 105, the capstan drive unit 110, the main drive 115 and cable drum 120 are illustrated, the drum drive and the apparatus being hidden or left out in the illustration of FIG. 2, wherein, in addition, a hook 205 for suspending a load on the cable 105 is shown, wherein a cable entry roller 232 and a speed sensor 234 of the speed measuring device are shown.

The cable 105 is or can be wound up at one end onto the cable drums 120. At a second end of the cable 105, opposite the first end, the hook 205 is attached to the cable 105.

The speed measuring device of the winch 100, according to the exemplary embodiment illustrated in FIG. 2, has the cable entry roller 232 and the speed sensor 234. Here, the cable 105 in the cable entry section or cable inlet section of the winch 100 runs over the cable entry roller 232. The speed sensor 234 is arranged adjacent to the cable entry roller 232. The speed sensor 234 is designed to measure a speed of the cable entry roller 232. The speed of the cable entry roller 232 is the second speed which, together with the first speed, can be used to determine the torque value. The speed sensor 234 is designed, for example, to provide the measured speed of the cable entry roller 232 as the second speed or the second speed signal.

According to the exemplary embodiment shown in FIG. 2, the capstan drive unit 110 of the winch 100 has a plurality of cable rollers for receiving a plurality of windings of the cable 105. Purely by way of example, the plurality of windings of the cable 105 is four. Here, the cable rollers are arranged in two packs radially spaced apart from each other and having an in particular equal number of rigidly connected cable rollers lined up coaxially in a row. A first pack of cable rollers is arranged adjacent to the main drive 115 and can be driven by the main drive 115. A second pack of cable rollers is coupled mechanically to the first pack of cable rollers by means of a force transmission device. Here, the force transmission device is implemented as a belt, in particular a V-belt or toothed belt. Thus, each pack of cable rollers also has a belt pulley. Alternatively, each pack can have a cable roller molded in one piece and having a plurality of cable receiving grooves arranged axially offset.

Furthermore, according to the exemplary embodiment illustrated in FIG. 2, axes of rotation of the capstan drive unit 110, an axis of rotation of the cable drum 120 and an axis of rotation of the cable entry roller 232 are arranged and aligned parallel to one another within production tolerances.

The cable 105 extends and runs from the hook 205 into the cable entry section of the winch 100, over the cable entry roller 232, over the capstan drive unit 110 and into the cable drum 120. Between the cable entry roller 232 and the capstan drive unit 110 and between the capstan drive unit 110 and the cable drum 120, according to the exemplary embodiment illustrated in FIG. 2, there are also arranged cable run-off safeguards and/or cable guiding means.

Figure 3:
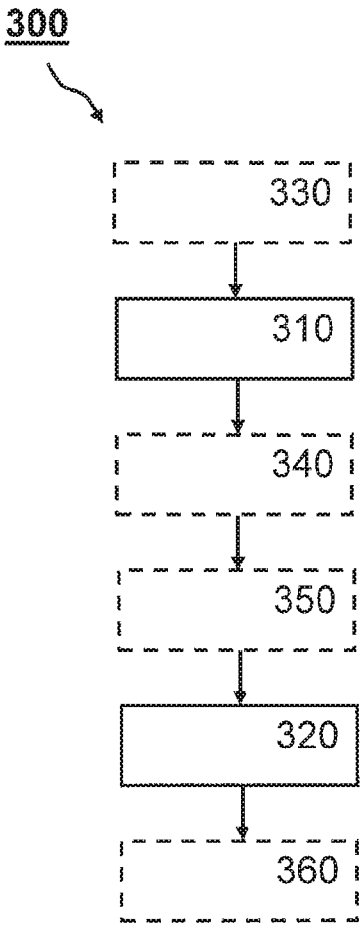
FIG. 3 shows a flow chart of a control method according to an exemplary embodiment.

FIG. 3 shows a flowchart of a control method 300 according to an exemplary embodiment. The method 300 can be carried out in order to control operation of a winch. Here, the control method 300 can be carried out in conjunction with or by using the winch from one of FIGS. 1 to 2 or a similar winch.

Here, the control method 300 has a step 310 of reading a first speed from the main drive and a second speed from the speed measuring device. In a determination step 320 which can be carried out following the reading step 310 in the method 300, a torque value for adjusting a torque of the drum drive is determined as a function of the first speed and the second speed, thus as a function of the speeds read in the reading step 310.

According to an exemplary embodiment, in the determination step 320 in the control method 300, the torque value in a starting state of the winch is determined as an initial value by using at least one cable load-dependent default value. Here, a reference table or the like having cable load-dependent default values can be used to determine the torque value as an initial value.

Optionally, the control method 300 further has a step 330 of measuring the first speed and the second speed. The measuring step 330 can be carried out before the reading step 310. In the measuring step 330, the first speed is measured by using the main drive, the second speed being measured by using the speed measuring device.

According to an exemplary embodiment, the control method 300 has a determination step 340 between the reading step 310 and the determination step 320 and, additionally or alternatively, a step 350 of carrying out a comparison. In the determination step 340, a speed difference and/or a speed ratio between the first speed and the second speed is determined. Here, in the determination step 320, the torque value is then determined as a function of the speed difference and/or the speed ratio. In the implementation step 350, a comparison of a mathematical relationship between the first speed and the second speed with a threshold value for the mathematical relationship is carried out. The mathematical relationship is, for example, the speed difference and/or the speed ratio. In the determination step 320, the torque value is determined on the basis of a result of the comparison.

Furthermore, the control method 300 optionally has a providing step 360, wherein the providing step 360 can be carried out after the determination step 320. In the providing step 360, a control signal for activating the drum drive is provided. Here, the control signal represents the torque value determined in the determination step 320.

Figure 4:
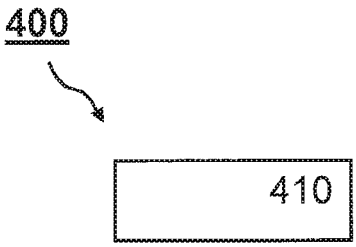
FIG. 4 shows a flow chart of an operating method according to an exemplary embodiment.

FIG. 4 shows a flowchart of an operating method 400 according to an exemplary embodiment. The method 400 can be carried out in order to operate a winch. In particular, the method 400 can be carried out in order to operate the winch from one of FIGS. 1 to 2 or a similar winch. The method 400 can be carried out in conjunction with the method for controlling operation of the winch from FIG. 3 or a similar control method.

The operating method 400 has a step 410 of controlling operation of the winch in order to haul a cable into the winch or to bring out the cable from the winch. The control step 410 comprises the steps of the control method from FIG. 3 as part steps. Expressed in another way, in the control step 410, the steps of the control method from FIG. 3 are carried out as part steps.

According to an exemplary embodiment, in the control step 410, the torque of the drum drive is adjusted until a mathematical relationship between the first speed and the second speed complies with a threshold value or a slip limit value.

In the following text, an exemplary embodiment will be explained with reference to FIGS. 1 to 4 in other words and in summary. As a result of the use of two independent drives, the main drive 115 and the drum drive 125, and as a result of detecting, for example, speed differences between the main drive 115 and the speed measuring device 130 incorporated in the cable entry, in particular anti-slip control can be integrated and implemented in the winch 100. The torque with which the cable drum 120 is driven, and thus a cable tension through the cable drum 120, are a measure of the force with which the capstan drive unit 110 moves a load on the hook 205. If the cable tension is too low, the cable 105 can slip on the capstan drive unit 110, which in turn leads to a speed difference between this first speed on the capstan drive unit 110 and the second speed measured at the cable entry by means of the speed measuring device 130. Here, an open-loop or closed-loop control process intervenes by using the control method 300 and/or the operating method 400, and the torque of the on the cable drum 120 can be increased until slip in the capstan drive unit 110 is eliminated and the speed difference is brought below a threshold value. In order to set an advantageous or necessary torque of the cable drum 120 when starting the winch 100 or rescue winch 100, a torque/load table can have been or can be stored, from which the initial value can be read. After that, a slip limit can be determined and this can then be set as already described.

According to an exemplary embodiment, it would also be possible to operate with two separate drives without coupling these in control terms. A drive of the cable drum would then be simply torque-controlled, with a fixed torque, and the main drive on the capstan drive would then be speed-controlled.

The exemplary embodiments described and shown in the figures have been chosen only by way of example. Different exemplary embodiments can be combined with one another completely or in relation to individual features. In addition, an exemplary embodiment can be supplemented by features of a further exemplary embodiment.

Furthermore, method steps according to the invention can be repeated and carried out in a different order than in that described.

If an exemplary embodiment comprises an "and/or" combination between a first feature and a second feature, then this is to be read such that the exemplary embodiment according to one embodiment has both the first feature and the second feature and, according to a further embodiment, has only the first feature or only the second feature.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for controlling operation of a winch, wherein the method can be carried out in conjunction with a winch which has a capstan drive unit for hauling a cable into the winch and bringing out the cable from the winch, a main drive for driving the capstan drive unit, a cable drum for receiving the cable by winding up and unwinding the cable, a drum drive for driving the cable drum, wherein the drum drive and the main drive can be operated independently of each other, and has a speed measuring device which is arranged in a cable entry section of the winch, the method comprising:

reading a first speed, which represents a speed of the main drive, and a second speed, which represents a speed measured by the speed measuring device; and determining a torque value for adjusting a torque of the drum drive as a function of the first speed and the second speed.

2. The method as claimed in claim 1, having a step of measuring the first speed and the second speed, wherein the first speed is measured by using the main drive and the second speed is measured by using the speed measuring device.

3. The method as claimed in claim 1, having a step of determining a speed difference and/or a speed ratio between the first speed and the second speed, wherein in the determination step, the torque value is determined as a function of the speed difference and/or speed ratio.

4. The method as claimed in claim 1, having a step of performing a comparison of a mathematical relationship between the first speed and the second speed with a threshold value for the mathematical relationship, wherein in the determination step, the torque value is determined on the basis of a result of the comparison.

5. The method as claimed in claim 1, in which in the determination step, the torque value in a starting state of the winch is determined as an initial value by using at least one cable load-dependent default value.

6. The method as claimed in claim 1, having a step of providing a control signal for activating the drum drive, wherein the control signal represents the torque value.

7. A method for controlling operation of a winch, wherein the winch has a capstan drive unit for hauling a cable into the winch and bringing out the cable from the winch, a main drive for driving the capstan drive unit, a cable drum for receiving the cable by winding up and unwinding the cable, a drum drive for driving the cable drum, wherein the drum drive and the main drive can be operated independently of each other, and has a speed measuring device which is arranged in a cable entry section of the winch, the method comprising:

controlling operation of the winch by carrying out the steps of the method as claimed in claim 1, in order to haul a cable into the winch or to bring out the cable from the winch.

8. The method as claimed in claim 7, in which in the control step, the torque of the drum drive is adjusted until a mathematical relationship between the first speed and the second speed complies with a threshold value.

9. An apparatus which is designed to carry out, activate and/or implement the steps of one of the methods as claimed in claim 1 in corresponding devices.

10. A winch comprising:

a capstan drive unit for hauling a cable into the winch and bringing the cable out of the winch;

a main drive for driving the capstan drive unit;

a cable drum for receiving the cable by winding up and unwinding the cable;

a drum drive for driving the cable drum, wherein the drum drive and the main drive can be operated independently of each other;

a speed measuring device, which is arranged in a cable entry section of the winch; and an apparatus as claimed in claim 1, wherein the apparatus is or can be connected to the main drive, the drum drive and the speed measuring device so as to be able to transmit signals.

11. The winch as claimed in claim 10, in which the speed measuring device has a cable entry roller and a speed sensor, wherein the speed sensor is designed to measure a speed of the cable entry roller.

12. The winch as claimed in claim 11, in which the speed sensor is designed to measure the speed of the cable entry roller in a non-contacting manner.

13. The winch as claimed in claim 10, in which the capstan drive unit has a plurality of cable rollers for receiving a plurality of windings of the cable, wherein the plurality of cable rollers are arranged in two packs radially spaced apart from each other with the same number of rigidly connected cable rollers lined up coaxially in a row, wherein a first pack can be driven by the main drive, wherein a second pack is coupled mechanically to the first pack by means of a force transmitting device.

14. The winch as claimed in claim 10, in which axes of rotation of the capstan drive unit, the cable drum and the speed measuring device are parallel to one another within production tolerances.

15. A computer program product with program code for implementing the method as claimed in claim 1 when the program product is executed on an apparatus.

* * * * *